United States Patent [19]

Le et al.

[11] Patent Number: 4,913,794

[45] Date of Patent: Apr. 3, 1990

[54] PROCESS CONFIGURATION FOR PRODUCING HIGH VISCOSITY LUBRICATING OILS

[75] Inventors: Quang N. Le, Cherry Hill, N.J.; Robert A. Ware, Wyndmoor, Pa.; Stephen S. Wong, Medford, N.J.

[73] Assignee: Mobil Oil Corp., New York, N.Y.

[21] Appl. No.: 379,511

[22] Filed: Jul. 13, 1989

Related U.S. Application Data

[63] Continuation-in-part of Ser. No. 179,795, Apr. 11, 1988, abandoned.

[51] Int. Cl.[4] ..... C10G 71/00

[52] U.S. Cl. ..... 208/18; 208/291; 252/55

[58] Field of Search ..... 208/18, 291; 252/55

[56] References Cited

U.S. PATENT DOCUMENTS

| | | | |
|---|---|---|---|
| 3,128,246 | 4/1964 | Oberright et al. | 258/255 |
| 3,594,320 | 7/1971 | Orkin | 585/10 |
| 4,594,172 | 6/1986 | Sie | 252/55 |
| 4,618,737 | 10/1986 | Chester et al. | 585/329 |
| 4,743,391 | 5/1988 | Gordon | 252/55 |

FOREIGN PATENT DOCUMENTS

| | | | |
|---|---|---|---|
| 1454498 | 11/1976 | United Kingdom | 258/18 |

*Primary Examiner*—Anthony McFarlane
*Attorney, Agent, or Firm*—Alexander J. McKillop; Charles J. Speciale; Robert B. Furr, Jr.

[57] ABSTRACT

A process is disclosed for improving the Viscosity Index of a hydrocarbon lubricating oil comprising the steps of providing a flow reactor having separate first and second inlet ports for the separate co-injection of lubricating oil and an organic peroxide, charging said lubricating oil and said organic peroxide of said flow reactor through said first and second inlet ports respectively, controlling the relative flowrates of said lubricating oil and organic peroxide reactants together with the total volumetric flowrate through said flow reactor to maintain a flow regime which favors diffusional mixing between said organic peroxide and said lubricating oil, and maintaining said organic peroxide and said lubricating oil under conversion conditions including temperatures of between about 50° and 300° C. and pressure sufficient to maintain said lubricating oil and said organic peroxide substantially in the liquid phase. Controlling the flow regime to favor diffusional rather than convective mixing between the lubricating oil and the organic peroxide has surprisingly been found to markedly enhance Viscosity Index improvement.

16 Claims, 3 Drawing Sheets

PROCESS CONFIGURATION FOR PRODUCING HIGH VISCOSITY LUBRICATING OILS

CROSS-REFERENCE TO RELATED APPLICATIONS

This is a continuation-in-part of application Ser. No. 179,795 filed Apr. 11, 1988, now abandoned.

Co-pending application Ser. No. 081,937, filed Aug. 5, 1987 (Mobil docket 4361), relates to the use of peroxide treatment for the production of controlled viscosity hydrocracked lubricant products. Co-pending application Ser. No. 081,935, filed Aug. 5, 1987, aband. (Mobil docket 4360), relates to the production of turbine oils using a peroxide treatment.

Co-pending application Ser. No. 081,790 filed Aug. 5, 1987, aband. (Mobil docket 4362 S), relates to the production of high Viscosity Index oils of low pour point with controlled viscosity characteristics.

Co-pending application Ser. No. 081,936 filed Aug. 5, 1987, aband. (Mobil docket 4411), relates to the production of lubricants of improved properties by reacting hydrocarbon lubricant base stocks with an organic peroxide compound, making staged incremental additions of the peroxide to the hydrocarbon.

FIELD OF THE INVENTION

The present invention relates to the production of petroleum-based lubricants. In particular, the present invention provides a method for increasing viscosity and Viscosity Index while maintaining a low pour point.

BACKGROUND OF THE INVENTION

Mineral oil lubricants are derived from various crude oil stocks by a variety of refining processes directed to obtaining a lubricant base stock of suitable boiling point, viscosity, Viscosity Index (VI) and other characteristics. Generally, the base stock will be produced from the crude oil by distillation of the crude in atmospheric and vacuum distillation towers, followed by the separation of undesirable aromatic components and finally, by dewaxing and various finishing steps. Aromatic components lead to high viscosity and extremely poor viscosity indices. Consequently, the use of asphaltic type crudes is not preferred as the yield of acceptable lube stocks will be extremely low after the large quantities of aromatic components contained in such crudes have been removed. Paraffinic and naphthenic crude stocks will therefore be preferred but aromatic separation procedures will still be necessary in order to remove undesirable aromatic components. In the case of the lubricant distillate fractions, generally referred to as the neutrals, e.g. heavy neutral, light neutral, etc., the aromatics will be extracted by solvent extraction using a solvent such as phenol, furfural, N-methylpyrrolidone or another material which is selective for the extraction of the aromatic components. If the lube stock is a residual lube stock, the asphaltenes will first be removed in a propane deasphalting (PDA) step followed by solvent extraction of residual aromatics to produce a lube generally referred to as bright stock.

Following the aromatics extraction step, dewaxing is normally used in order to improve the low temperature fluidity characteristics of the oil. Fluidity of a lubricant is normally determined by the pour point (ASTM D97). Generally, low pour point is desirable in order to ensure that the lubricant remains sufficiently fluid to function properly at the low temperatures which may be encountered in operation. Dewaxing may be carried out using conventional solvent dewaxing techniques, for example, solvent dewaxing with mixtures of methylethyl ketone (MEK) and toluene or by auto-refrigerant type solvent processes using liquid propane. Catalytic dewaxing is a highly satisfactory alternative to solvent dewaxing and a number of catalytic dewaxing processes are in commercial use. The Mobil lube oil dewaxing process (MLDW) is described in *Catal. Rev. Sci. Eng.* 28 (2 and 3) 185–264 (1986), especially 244–247. See also 1986 *Refining Process Handbook*, Gulf Publishing Co. (Sept., 1986, Hydrocarbon Processing) page 90.

Other treatment processes may also be employed to improve the properties of lubricants produced by refining techniques such as these, including hydrotreating to remove unsaturated compound color bodies and heteroatom-containing impurities, especially sulfur.

The desired viscosity for each lubricant product is determined by its intended use. The range of product viscosities will extend from light or less viscous oils such as the spindle oils and light neutral oils to heavy or viscous oils such as heavy neutral or bright stock. This range of viscosities is generally obtained by using fractions of different boiling point from the vacuum distillation tower. The lower boiling fractions are usually highly paraffinic and of low viscosity and these are typically used to produce the less viscous oils such as light neutral. More viscous, but still highly paraffinic oils are produced by using higher boiling distillates and the most viscous oils of all are produced from the more aromatic residual fractions which contain larger proportions of aromatic components resulting in the higher viscosity. Thus, in conventional refining techniques the viscosity of a lubricant is determined at least to some extent by its chemical composition. Certain viscous lubricants, however, may need to possess characteristics which are inconsistent with their normal chemical composition. For example, if a lubricant of marked stability is required, it is generally desirable to avoid the presence of aromatics which lead to poor oxidation and thermal stability. However, if this lubricant is also required to possess a relatively high viscosity, conventional refining techniques will introduce significant quantities of aromatic component. The formulation of certain types of lubricant has therefore been a compromise to satisfy such conflicting requirements.

The use of peroxide treatments for modifying the properties of various lube stocks including distillates and hydrocracked resids has been described in U.S. Pat. Nos. 3,128,246 and 3,594,320. Other peroxide treatment processes used with lubricants of synthetic origin are described in U.S. Pat. Nos. 4,594,172 and 4,618,737. As described in U.S. Pat. No. 3,128,246, treatment with peroxide improves the high temperature characteristics of the oil and in addition, raises its viscosity. Thus, this proposal provides some potential for controlling the viscosity of a lubricant independently of its chemical composition. However, the simple peroxide treatment is attended by a number of difficulties. The most significant of these is of controlling the treatment process in order to obtain products of high quality and predictable viscosity and Viscosity Index.

Viscosity Index (VI) is the most common measure that is applied to the decrease in viscosity of petroleum oils with increasing temperature. A series of Pa. oils exhibiting relatively small change in viscosity with changing temperature is arbitrarily assigned a VI of 100, whereas a series of Gulf Coast oils whose viscosities change relatively greatly is assigned a VI of 0. From the viscosity measurements at 40° and 100° C., the VI of any oil sample can be obtained from detailed tables published by the ASTM (ASTM D 2270). 14 *Kirk-Othmer Encyclopedia of Chemical Technology,* 489, (Wiley, 1981).

It has been found that the treatment of a lubricating oil stock by the addition of peroxide at the inlet of a continuous flow reactor results in both an expected increase in viscosity and an unexpected improvement in the Viscosity Index with no adverse effect on pour point.

SUMMARY OF THE INVENTION

A process is disclosed for improving the Viscosity Index of a hydrocarbon lubricating oil comprising the steps of providing a flow reactor having separate first and second inlet ports for the separate co-injection of lubricating oil and an organic peroxide, charging said lubricating oil and said organic peroxide to said flow reactor through said first and second inlet ports respectively, controlling the relative flowrates of said lubricating oil and organic peroxide reactants together with the total volumetric flowrate through said flow reactor to maintain a flow regime which favors diffusional mixing between said organic peroxide and said lubricating oil, and maintaining said organic peroxide and said lubricating oil under conversion conditions including temperatures of between about 50° and 300° C. and pressure sufficient to maintain said lubricating oil and said organic peroxide substantially in the liquid phase. Controlling the flow regime to favor diffusional rather than convective mixing between the lubricating oil and the organic peroxide has surprisingly been found to markedly enhance Viscosity Index improvement.

DETAILED DESCRIPTION

Figure 1:
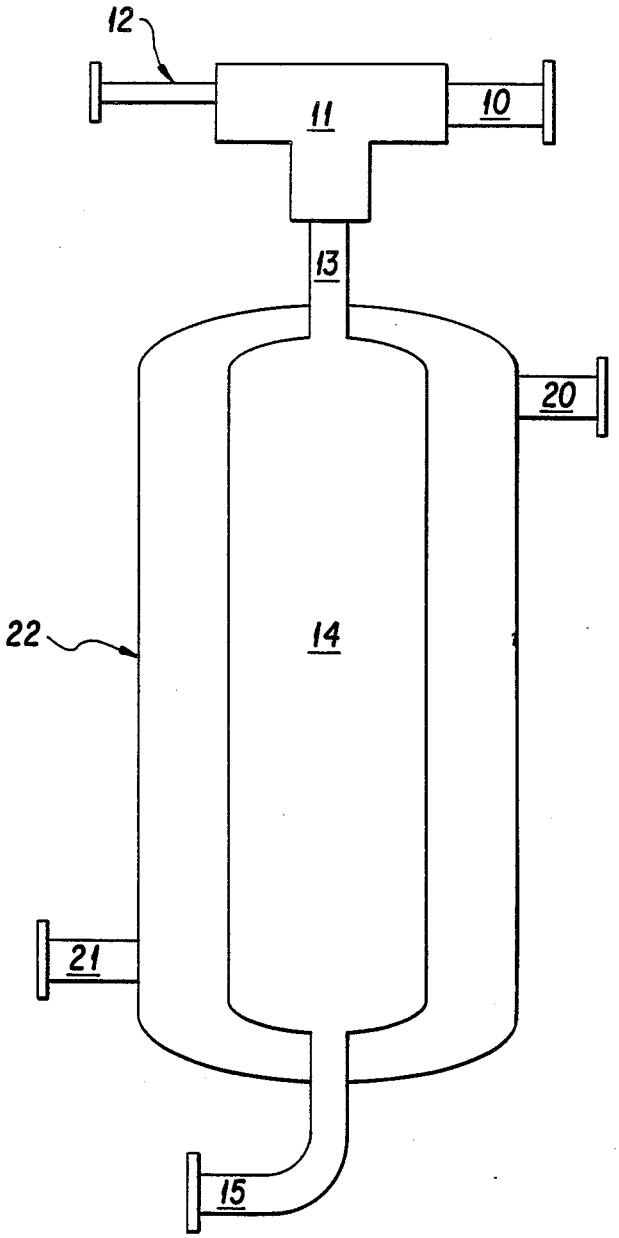
FIG. 1 is a simplified drawing of a reactor suitable for continuously treating a hydrocarbon lube stock with a peroxide.

The present treatment process is useful with a wide range of lubricant stocks of mineral oil or synthetic origin including neutral (distillate) and residual lube stocks produced by the conventional refining techniques described above as well as synthetic lube stocks produced by processes such as Fischer-Tropsch synthesis, and olefin oligomerization processes. Olefin oligomerization processes suitable for producing lube stocks are described in U.S. Pat. Nos. 4,520,221; 4,547,613; 4,517,399; 4,126,644; 3,322,848 and 4,618,737. Reference is made to these patents for a description of such processes. A process for producing high viscosity index lube oils by Fischer-Tropsch synthesis is described in U.S. Pat. No. 4,594,172 to which reference is made for a description of such a process. The present process is also applicable to the treatment of oils such as turbine oils as described in copending application Ser. No. 081,935 (Mobil Case 4360) and to oils produced by other special refining techniques including the wax hydroisomerization/dewaxing processes as described in copending applications Ser. Nos. 793,937, 044,187 and 081,790 (Mobil Cases 3730, 4309S and 4362S). It is also applicable to the treatment of hydrocracked lube oils, for example, as disclosed in copending application Ser. No. 081,937 (Mobil Case 4361). Reference is made to these copending applications for descriptions of suitable and preferred lube stocks for treatment with organic peroxides.

The oil may be subjected to conventional refining techniques prior to treatment with the peroxide so that the peroxide is reacted with the oil only after undesirable components have been removed, in order to avoid wasteful side reactions between peroxide and undesirable components. For this reason, it is normally preferred to remove aromatics by solvent extraction using a solvent such as furfural, phenol or n-methylpyrrolidone or by high pressure hydrotreating and also to carry out dewaxing prior to reaction with the peroxide. Removal of the waxy components prior to peroxide treatment is desirable because the waxy components are paraffins and are capable of reacting readily with the peroxide in order to produce even higher molecular weight paraffins whose presence may be undesirable in the finished lubricant. The solvent extraction and the dewaxing may be carried out in either order although most conventional refining units will perform the solvent extraction first. Dewaxing may be by either solvent or catalytic dewaxing techniques.

The selected oil is subjected to treatment with an organic peroxide compound at elevated temperature in order to effect coupling of the paraffinic components (including paraffins and alkyl side chains on ring compounds). The preferred peroxides are the ditertiary alkyl peroxides represented by the formula $ROOR^1$ where R and $R^1$ are the same or different tertiary alkyl radicals, preferably lower (C4 to C6) tertiary alkyl radicals. Suitable peroxides of this kind include ditertiary butyl peroxide, ditertiary amyl peroxide and tertiary butyl, tertiary amyl peroxide. Other organic peroxides may also be used including dialkyl peroxides with one to ten carbon atoms such as dimethyl peroxide, diethyl peroxide, dipropyl peroxide, di-n-butyl peroxide, dihexyl peroxide, acetylperoxides such as dibenzoylperoxide.

The amount of peroxy compound used in the process is determined by the increase in viscosity and Viscosity Index which is desired in the treatment. In general, the increase in viscosity and Viscosity Index is related to the amount of peroxide used, with greater increases resulting from greater amounts of peroxide. As a general guide, the amount of peroxide employed will be from 0.1 to 50, preferably from 1 to 20 weight percent of the oil. There is essentially an exponential relationship between the proportion of peroxide used and the viscosity increase, both with batch and continuous reaction. The presence of hydrogen may decrease peroxide utilization slightly but significant increases in viscosity may still be obtained without other lube properties (pour point, V.I.) being significantly affected. It would therefore be practicable to cascade the effluent from a catalytic hydrodewaxing unit directly to a peroxide treatment reactor, permitting the hydrogen to remain in the stream. The coupling of paraffinic components being out of the lube boiling range would, in this case, increase lube yield and for this reason may represent a preferred process configuration.

The reaction between the lube fraction and the peroxide is carried out at elevated temperature, suitably at temperatures from about 50° C. to about 300° C. and in most cases from 100° C. to about 200° C. The treatment duration will normally be from about 1 hour to 6 hours but there is no fixed duration since various starting materials will vary in their reactivity and amenability to treatment by this method. The pressure employed will depend upon the temperature used and upon the reactants and, in most cases, needs to be sufficient only to maintain the reactants in the liquid phase during the course of the reaction. Space velocity in continuous operation will normally be from 0.25 to 5.0 LHSV ($hr^{-1}$).

The peroxide is converted during the reaction to an alcohol whose boiling point will depend upon the identity of the selected peroxide. This alcohol byproduct may be removed during the course of the reaction by simple choice of temperature and pressure and accordingly temperature and pressure may be selected together to ensure removal of this byproduct. The alcohol may be converted back to the peroxide in an external regeneration step and recycled for further use, as described in Ser. Nos. 081,937 and 081,935 (Mobil Cases 4361 and 4360). If ditertiary butyl peroxide is used, the ditertiary butyl alcohol formed may be used directly as a gasoline octane improver.

It has been found that when the peroxide compound and the lube oil stock are both injected at the inlet of a substantially isothermal packed bed or tubular reactor, the Viscosity Index (VI) increases dramatically with increasing viscosity. The examples below show that a slight (1-2 VI numbers) increase in Viscosity Index accompanies an increase in viscosity when the lube oil is treated with a peroxide compound in a batch reactor. In contrast, the same mixture of reactants charged continuously to the inlet of a tubular or packed bed reactor has been found to produce an increase in Viscosity Index of between about 4 and about 14 VI numbers as well as an increase in viscosity approximately equal to that noted for the batch reaction. The increase in Viscosity Index is an unexpected and surprising result.

FIG. 1 illustrates a useful reactor configuration providing substantially isothermal reaction conditions. A tubular reactor vessel 14 is provided with inlet piping 13 through which the mixture of oil and peroxide enters the reactor. The reactor vessel 14 is encased by a heating jacket 22 having an inlet 20 and an outlet 21 such that a suitable heat transfer fluid may flow through the heating jacket 22 and around tubular reactor vessel 14 thus maintaining a uniform temperature profile through the reactor vessel. Tubular reactor vessel 14 may optionally be filled with an inert packing material.

Preheated lube oil stock and peroxide enter mixing tee 11 through conduits 10 and 12, respectively. The two components are contacted and flow out of the mixing tee into the tubular reactor vessel inlet 13.

Reactor effluent leaves the tubular reactor vessel 14 through outlet piping 15. The reactor effluent may pass to a product separator where low boiling point byproducts such as alcohol may be removed for regeneration into peroxide and recycled, as described above.

EXAMPLES 1-3

Figure 2:
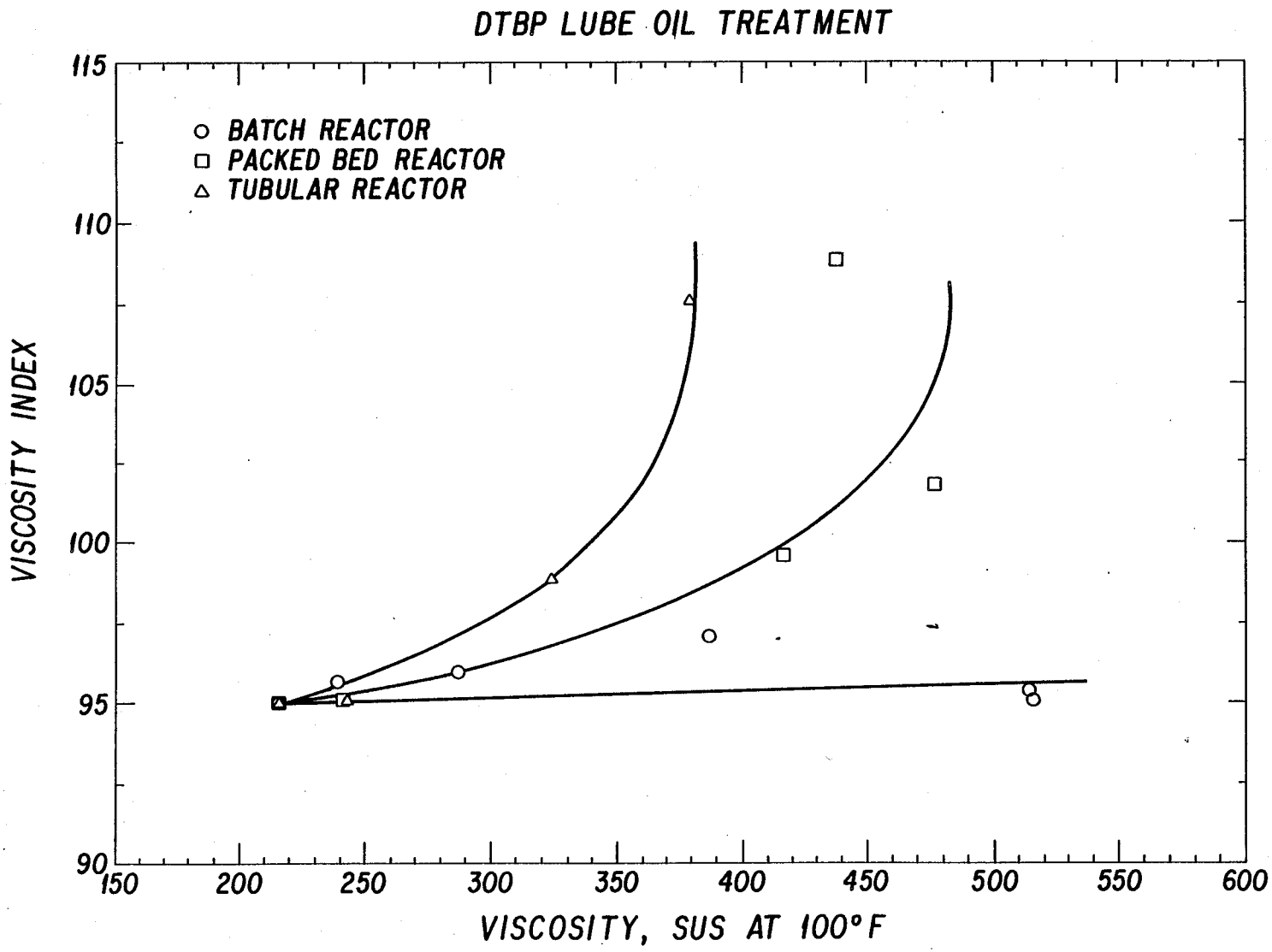
FIG. 2 is a graph showing the relationship between viscosity and viscosity index for a batch reactor, a packed bed reactor and a tubular reactor.

These examples illustrate the batch treatment of a commercial light neutral lubricating base stock with a peroxide. The properties of the lube oil base stock are shown in Table 1. The reaction was carried out over a range of temperatures to ascertain the effect of temperature on the reaction rate and product properties. In each of these examples, a lube oil was mixed with a 10 wt. % dosage of ditertiary butyl peroxide (DTBP) and reacted in a batch reactor under constant agitation. During the course of the reaction, the mixture was sampled to measure the increase in the viscosity and the Viscosity Index. The results of Examples 1-3 are presented in Table 2. FIG. 2 shows a plot of viscosity versus Viscosity Index for the batch reactor indicated by circular data points.

TABLE 1

| Feedstock Properties | |
|---|---|
| Pour, °F. | 15 |
| KV @40° C.,cS | 41.54 |
| KV @100° C.,cS | 6.231 |
| SUS @100° F. | 214 |
| VI | 95 |
| **Distillation °F. (D-2887)** | |
| 1% | 648 |
| 10% | 731 |
| 30% | 787 |
| 50% | 829 |
| 70% | 872 |
| 90% | 922 |
| 95% | 941 |
| Gravity, @API | 30 |

TABLE 2

Reaction of 10 wt. % DTBP with Commercial Light Neutral Lubricating Basestock in Batch Reactor

| | Example 1 | Example 2 | Example 3 |
|---|---|---|---|
| Reactor T, °F. | 265 | 300 | 365 |
| Rxn Time, hrs | 2 | 2 | 2 |
| Product Properties | | | |
| Pour, °F. | 15 | 10 | 0 |
| KV @40° C.,cS | 45.95 | 74.05 | 98.22 |
| KV @100° C., cS | 6.655 | 9.127 | 10.96 |
| SUS @100° F. | 237 | 385 | 513 |
| VI | 95.7 | 97.2 | 95.5 |

EXAMPLES 4-7

Examples 4-7 illustrate the treatment of the commercial light neutral lubricating base stock used in the previous examples with a peroxide in a continuous flow packed-bed reactor. DTBP and the lube oil stock were concurrently injected into the inlet of a continuous flow packed-bed reactor at a 10 wt. % DTBP dosage and a liquid hourly space velocity of 0.25 $hr^{-1}$. The reactor was packed with 20/30 mesh inert sand particles (Ottawa Standard, Fisher Scientific #S-23) to promote contact between the DTBP and the lube oil during the reaction. The reaction was carried out over a range of temperatures to ascertain the effect of temperature on reaction rate and product properties. Table 3 shows the results of Examples 4-7, while the rectangular data points of FIG. 2 show a plot of viscosity versus Viscosity Index for a packed-bed reactor.

TABLE 3

Reaction of 10 wt. % DTBP with Commercial Light Neutral Lubricating Stock in Packed-Bed Reactor

| | Example 4 | Example 5 | Example 6 | Example 7 |
|---|---|---|---|---|
| Reactor T °F. | 300 | 350 | 400 | 450 |
| LHSV, $hr^{-1}$ | 0.25 | 0.25 | 0.25 | 0.25 |
| Product Properties | | | | |
| Pour, °F. | 20 | 5 | 20 | 15 |

TABLE 3-continued

| Reaction of 10 wt. % DTBP with Commercial Light Neutral Lubricating Stock in Packed-Bed Reactor | Example 4 | Example 5 | Example 6 | Example 7 |
|---|---|---|---|---|
| KV @40° C., cS | 46.26 | 79.93 | 91.56 | 84.26 |
| KV @100° C., cS | 6.671 | 9.737 | 10.820 | 10.570 |
| SUS @100° F. | 239 | 415 | 476 | 437 |
| VI | 95.2 | 99.7 | 102.0 | 109.0 |

EXAMPLES 8-10

In Examples 8-10, the lube base stock of the previous examples was treated with a 10 wt. % dosage of DTBP in a tubular reactor consisting of an empty 3/16 inch OD (0.035" wall) tube coiled into a spring and placed inside a ¾ inch OD reactor tube located in a furnace. The available volume for reaction within the coiled tube was 13.5 cc. The results of Examples 8-10 are shown in Table 4. The triangular data points in FIG. 2 show a plot of viscosity versus Viscosity Index for a tubular reactor.

TABLE 4

| Reaction of 10 wt. % DTBP with Commercial Light Neutral Lubricating Stock in Tubular Reactor | Example 8 | Example 9 | Example 10 |
|---|---|---|---|
| Reactor T, °F. | 351 | 402 | 451 |
| LHSV, hr −1 | 1.0 | 1.0 | 1.0 |
| Product Properties | | | |
| Pour, °F. | 20 | 5 | 15 |
| KV @40° C., cS | 46.55 | 62.39 | 73.30 |
| KV @100° C., cS | 6.697 | 8.206 | 9.531 |
| SUS @100° F. | 241 | 323 | 379 |
| VI | 95.2 | 99.0 | 107.8 |

EXAMPLES 11-19

The previous Examples compared the reaction of a commercial light neutral basestock with a peroxide in batch and flow reactors. The Viscosity Index increase shown in Examples 8-10 (tubular reactor) exceeded that shown in Examples 4-7 (packed bed reactor). The results of both flow reactions exceeded the Viscosity Index increase noted for the batch reactions of Examples 1-3.

Examples 11-19 were then conducted to ascertain the effect of mixing on Viscosity Index enhancement. The constantly agitated batch reactor of Examples 1-3 provides more uniform mixing than the packed bed reactor of Examples 4-7. Both the continuously agitated batch reactor of Examples 1-3 and the packed bed reactor of Examples 4-7 mix oil and peroxide more intimately than the tubular reactor of Examples 8-10. While not introduced to limit the scope of the invention by a recitation of theory, it is believed that the Viscosity Index enhancement is inversely related to the degree of agitation of the reactants. This may be explained by certain backmixing effects as follows. By limiting the extent of mixing to approach that attained by pure diffusion rather than convection, it is believed that locally high concentrations of lubricating oil and organic peroxide react to form compounds which, when mixed with the remaining unreacted lubricating oil, yield a product having a higher Viscosity Index than would be produced under similar process conditions with more intimate mixing or reactants.

Figure 3:
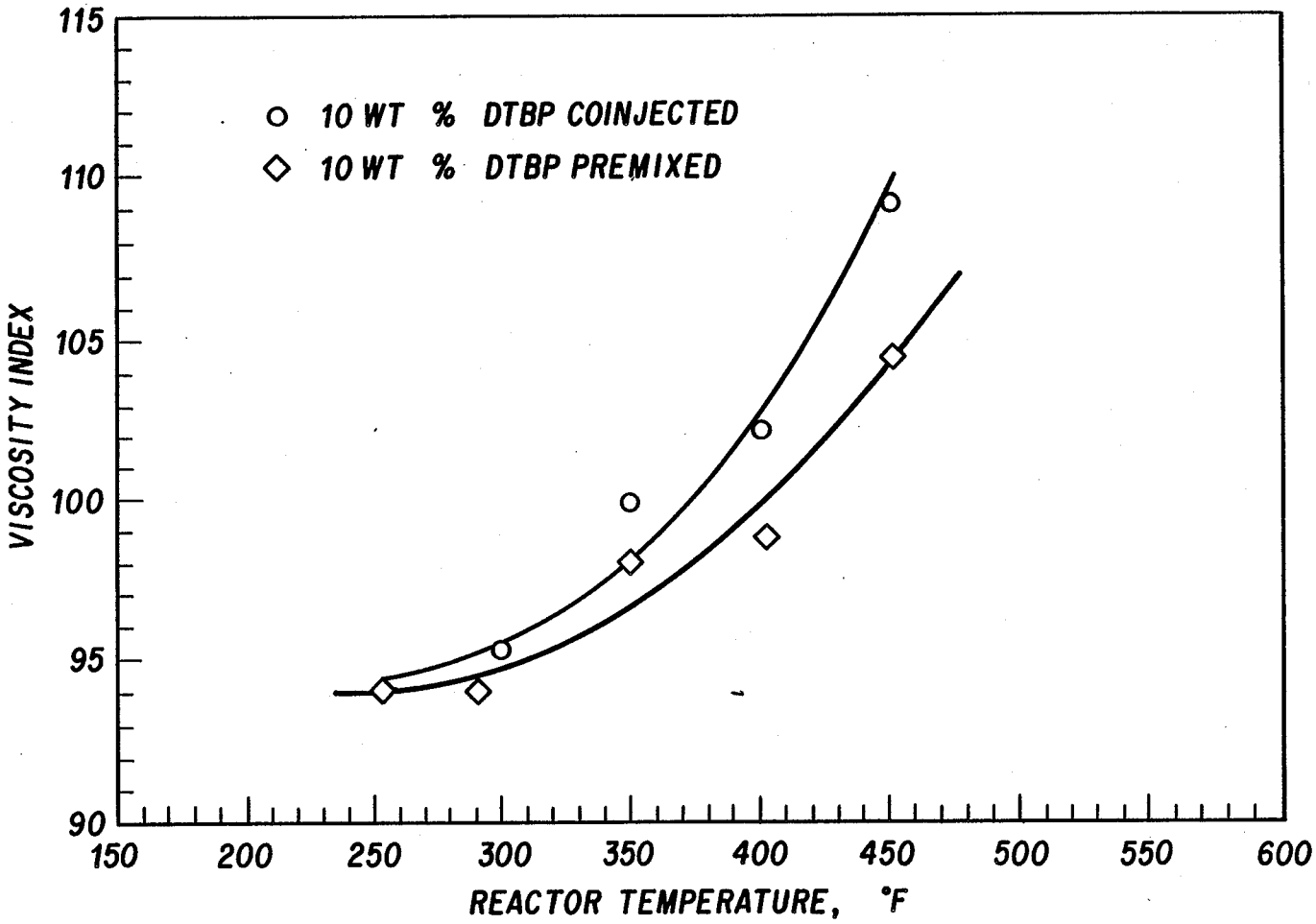
FIG. 3 is a graph illustrating the effects of convective mixing on Viscosity Index enhancement.

Accordingly, Examples 11-19 show the mixing effect on Viscosity Index for a 10 wt % ditertiary butyl peroxide treatment of a light neutral distillate stock. Separate co-injection of the peroxide and lubricating oil stock as shown in Examples 11-14 of Table 5 consistently yielded greater Viscosity Index increases than pre-mixing the reactants as shown in Examples 15-19 of Table 5. Thus the extent of mixing clearly affects Viscosity Index increase. These results are shown Graphically in FIG. 3.

TABLE 5

| Comparison of Co-injected and Pre-mixed 10 wt % Ditertiary Butyl Peroxide (DTBP) Treatment of Light Neutral in Packed-Bed Reactor | | Co-injected | | | | Pre-mixed | | | | |
|---|---|---|---|---|---|---|---|---|---|---|
| | Feed | Ex. 11 | Ex. 12 | Ex. 13 | Ex. 14 | Ex. 15 | Ex. 16 | Ex. 17 | Ex. 18 | Ex. 19 |
| Reactor Temp, °F. | — | 300 | 350 | 400 | 450 | 253 | 290 | 350 | 402 | 451 |
| Product Properties | | | | | | | | | | |
| Pour, °F. | 15 | 20 | 5 | 20 | 15 | 15 | 15 | 15 | 20 | 10 |
| KV @40° C., cS | 41.54 | 46.26 | 79.93 | 91.56 | 84.26 | 41.9 | 44.19 | 80.47 | 78.72 | 71.58 |
| KV @100° C., cS | 6.231 | 6.671 | 9.737 | 10.82 | 10.57 | 6.244 | 6.460 | 9.694 | 9.584 | 9.227 |
| SUS @100° C., cS | 214 | 239 | 415 | 476 | 437 | 216 | 228 | 418 | 409 | 371 |
| VI | 95 | 95.2 | 99.7 | 102 | 109 | 94 | 93.9 | 97.9 | 98.6 | 104.3 |

All experiments conducted at 200 psig $N_2$, 1000 scf $N_2$/bbl oil, and 0.5 LHSV.

What is claimed is:

1. A process for improving the Viscosity Index of a hydrocarbon lubricating oil comprising the steps of:
   (a) providing a flow reactor having separate first and second inlet ports for the separate co-injection of lubricating oil and an organic peroxide;
   (b) charging said lubricating oil and said organic peroxide to said flow reactor through said first and second inlet ports respectively;
   (c) controlling the relative flowrates of said lubricating oil and organic peroxide reactants together with the total volumetric flowrate through said flow reactor to maintain a flow regime which favors diffusional mixing between said organic peroxide and said lubricating oil; and
   (d) maintaining said organic peroxide and said lubricating oil under conversion conditions including temperatures of between about 50° and 300° C. and pressure sufficient to maintain said lubricating oil and said organic peroxide substantially in the liquid phase.

2. The process of claim 1 further comprising controlling said total volumetric flowrate to maintain a substantially laminar flow regime within said flow reactor.

3. The process of claim 1 wherein step (a) further comprises providing a tubular flow reactor having separate first and second inlet ports for the separate co-injection of lubricating oil and an organic peroxide.

4. The process of claim 3 wherein said organic peroxide comprises a dialkyl peroxide.

5. The process of claim 3 wherein said organic peroxide comprises a ditertiary butyl peroxide.

6. The process of claim 3 wherein the total amount of organic peroxide added to said lubricant is between about 0.1 and about 50 wt. % of the lubricant.

7. The process of claim 3 wherein the total amount of organic peroxide added to said lubricant is between about 1 and about 20 wt. % of the lubricant.

8. The process of claim 3 further comprising maintaining the reactants at temperatures between about 50° C. and about 300° C. and maintaining liquid hourly space velocities at between about 0.25 and about 5.0 $hr^{-1}$.

9. The process of claim 3 further comprising controlling said total volumetric flowrate to maintain a substantially laminar flow regime within said flow reactor.

10. The process of claim 1 wherein step (a) further comprises providing a packed bed flow reactor having separate first and second inlet ports for the separate co-injection of lubricating oil and an organic peroxide.

11. The process of claim 10 wherein said organic peroxide is a dialkyl peroxide.

12. The process of claim 10 wherein said organic peroxide is a ditertiary butyl peroxide.

13. The process of claim 10 wherein the total amount of peroxide added to the lubricant is between about 0.1 and about 50 wt. % of the lubricant.

14. The process of claim 10 wherein the total amount of peroxide added to the lubricant is between about 1 and about 20 wt. % of the lubricant.

15. The process of claim 10 further comprising maintaining the reactants at temperatures between about 50° C. and about 300° C. and maintaining liquid hourly space velocities at between about 0.25 and about 5.0 $hr^{-1}$.

16. The process of claim 10 further comprising controlling said total volumetric flowrate to maintain a substantially laminar flow regime within said flow reactor.

* * * * *